US012523033B2

(12) United States Patent
Lee

(10) Patent No.: US 12,523,033 B2
(45) Date of Patent: Jan. 13, 2026

(54) COMPOSITE FRAME HAVING END-EMBEDDED GIRDER JOINT STRUCTURE

(71) Applicant: SENVEX CO., LTD., Seoul (KR)

(72) Inventor: Chang Nam Lee, Seoul (KR)

(73) Assignee: SENVEX CO., LTD., Seoul (KR)

( * ) Notice: Subject to any disclaimer, the term of this patent is extended or adjusted under 35 U.S.C. 154(b) by 328 days.

(21) Appl. No.: 18/271,861

(22) PCT Filed: Jan. 20, 2022

(86) PCT No.: PCT/KR2022/001073
§ 371 (c)(1),
(2) Date: Jul. 12, 2023

(87) PCT Pub. No.: WO2022/164128
PCT Pub. Date: Aug. 4, 2022

(65) Prior Publication Data

US 2024/0084579 A1 Mar. 14, 2024

(30) Foreign Application Priority Data

Feb. 1, 2021 (KR) ..... 10-2021-0014281

(51) Int. Cl.
*E04B 1/30* (2006.01)

(52) U.S. Cl.
CPC ..... *E04B 1/30* (2013.01)

(58) Field of Classification Search
CPC ..... E04B 1/30
See application file for complete search history.

(56) References Cited

FOREIGN PATENT DOCUMENTS

| | | | | | |
|---|---|---|---|---|---|
| JP | 11-159000 | A | | 6/1999 | |
| KR | 10-1490748 | B1 | | 2/2015 | |
| KR | 10-1658648 | B1 | | 9/2016 | |
| KR | 10-1711102 | B1 | | 2/2017 | |
| KR | 101904115 | B1 | * | 10/2018 | ..... E04C 3/293 |
| KR | 10-2019-0041785 | A | | 4/2019 | |
| KR | 20190041785 | A | * | 4/2019 | ..... E04C 3/36 |
| KR | 10-2019-0123025 | A | | 10/2019 | |
| KR | 10-2149128 | B1 | | 8/2020 | |

OTHER PUBLICATIONS

International Search Report for PCT/KR2022/001073 mailed May 4, 2022 from Korean Intellectual Property Office.

* cited by examiner

*Primary Examiner* — Joshua K Ihezie
(74) *Attorney, Agent, or Firm* — Revolution IP, PLLC

(57) ABSTRACT

The present invention relates to a composite frame having an end-embedded girder joint structure, wherein a girder body is simply placed in a U-shaped preassembled bracket assembly coupled to the upper end of a preassembled column assembly and, then, concrete is poured into and integrated with the assembly such that the composite frame can reduce a construction period and improve quality at the time of forming a steel-composite ferroconcrete structure and enable simple and rapid building of a beam-column joint, thereby securing the constructability and stability thereof.

5 Claims, 7 Drawing Sheets

FIG, 2

COMPOSITE FRAME HAVING END-EMBEDDED GIRDER JOINT STRUCTURE

TECHNICAL FIELD

The present invention relates to a composite frame having an end-embedded girder joint structure, in which a girder body is simply placed in U-shaped pre-assembled bracket assemblies coupled to the upper ends of pre-assembled column assemblies and then integrated by pouring concrete, thereby reducing a construction period and improving quality when forming a steel-concrete composite reinforced concrete structure and enabling simple and rapid construction of a beam-column joint while securing constructability and safety.

BACKGROUND ART

In reinforced concrete RC construction, a structure is constructed in the order of installing formworks and then arranging reinforcing bars inside the formworks and pouring and curing concrete. At this time, since the arrangement of reinforcing bars is performed on site, it takes a lot of man power and time and it is not easy to secure uniform quality. In addition, since the formworks are supported by external temporary materials, installation and disassembly processes of such temporary materials must be added, and the temporary materials may cause inconvenience to workers' passage and involve safety accidents.

In particular, in the case of large structures, there is a risk of safety accidents because formwork or rebar work is performed at height, and the installation scale of temporary materials increases, which may increase construction costs.

In order to solve the problems of the conventional RC construction method, it has been developed a formwork-integrated pre-assembled column in which lightweight permanent formworks are attached to a pre-assembled column frame (Korean Registered Patent No. 10-1490748).

The prior art technology is to fix formworks to a horizontal support member with high rigidity, wherein since the formworks are pre-attached at a factory, it is possible to minimize on-site formwork installation and disassembly work. In addition, it is possible to greatly decrease a construction period because there is no need for separate temporary supports.

Meanwhile, in Rahmen construction, columns and beams are connected to each other through rigid connection. Accordingly, a pre-assembled steel-concrete composite member or steel frame member is rigidly joined to a junction part of a beam member and a column member by welding or bolting.

However, on-site bonding of these members has problems in that it takes a long joining time, it is difficult to secure the quality of a joint part, and there are concerns about safety accidents due to work at height. In addition, since the joining work is performed in a state in which a beam member is lifted using a crane, there is a problem in that the operation efficiency of the lifting equipment is lowered.

DETAILED DESCRIPTION OF THE INVENTION

Technical Problems

In order to resolve the problems as described above, the present invention is to provide a composite frame having an end-embedded girder joint structure, in which a pre-assembled steel frame assembly is used for forming a steel-concrete composite RC structure, thereby reducing a construction period and improving frame quality.

According to the present invention, construction of a beam-column joint is very simple, thereby securing constructability and safety and ensuring very rapid joining work.

Problem Solving Means

According to a preferred embodiment of the present invention, there is provided a composite frame having an end-embedded girder joint structure, comprising: a plurality of pre-assembled column assemblies, each including a plurality of first main steel section members disposed in a vertical direction at each corner of a column member, and first connecting bars coupled to outer surfaces of the first main steel section members so as to interconnect the first main steel section members neighboring each other; pre-assembled bracket assemblies disposed in a transverse direction on upper ends of the pre-assembled column assemblies, having open upper surface portions, and including four second main steel section members, which are provided in a horizontal direction at left and right sides at intervals from each other up and down on the outside of the pre-assembled column assemblies and protrude to the outside of the pre-assembled column assemblies, and second connecting bars for interconnecting the second main steel section members neighboring each other vertically and interconnecting the second main steel section members neighboring each other on the left and right at lower portions, respectively; and a girder body, which is installed between the pre-assembled bracket assemblies coupled to the pre-assembled column assemblies which neighbor each other, and both end portions of which are inserted into the pre-assembled bracket assemblies so as to be mounted in the pre-assembled bracket assemblies.

According to another preferred embodiment of the present invention, there is provided a composite frame having an end-embedded girder joint structure, wherein a fixing bar is coupled to outer surfaces of the first main steel section members of the pre-assembled column assembly and one side of the fixing bar is fixed to the second main steel section member of the pre-assembled bracket assembly so as to fix the pre-assembled bracket assembly to the pre-assembled column assembly.

According to a further preferred embodiment of the present invention, there is provided a composite frame having an end-embedded girder joint structure, wherein the girder body is a PC member.

According to still another preferred embodiment of the present invention, there is provided a composite frame having an end-embedded girder joint structure, wherein the girder body includes a plurality of third main steel section members disposed in a longitudinal direction at each corner of the girder body, and third connecting bars coupled to the outer surfaces of the third main steel section members which neighbor each other.

According to a still further preferred embodiment of the present invention, there is provided a composite frame having an end-embedded girder joint structure, wherein upper connecting bars are coupled to the second main steel section members at upper portions of the pre-assembled bracket assembly so as to interconnect the second main steel section members which neighbor each other.

Effect of the Invention

According to the present invention, it is possible to provide a composite frame having an end-embedded girder joint structure, by simply placing end portions of a girder body the U-shaped pre-assembled bracket assemblies coupled to the upper ends of the pre-assembled column assemblies and then integrating by pouring concrete.

Therefore, by using a pre-assembled steel frame assembly for forming a steel-concrete composite RC structure, it is possible to reduce a construction period, improve frame quality and ensure simple and rapid construction of a beam-column joint while securing constructability and safety.

BEST MODE FOR CARRYING OUT THE INVENTION

In order to achieve the objects described above, according to the present invention, a composite frame having an end-embedded girder joint structure, comprises: a plurality of pre-assembled column assemblies, each including a plurality of first main steel section members disposed in a vertical direction at each corner of a column member, and first connecting bars coupled to outer surfaces of the first main steel section members so as to interconnect the first main steel section members neighboring each other; pre-assembled bracket assemblies disposed in a transverse direction on upper ends of the pre-assembled column assemblies, having open upper surface portions, and including four second main steel section members, which are provided in a horizontal direction at left and right sides at intervals from each other up and down on the outside of the pre-assembled column assemblies and protrude to the outside of the pre-assembled column assemblies, and second connecting bars for interconnecting the second main steel section members neighboring each other vertically and interconnecting the second main steel section members neighboring each other on the left and right at lower portions, respectively; and a girder body, which is installed between the pre-assembled bracket assemblies coupled to the pre-assembled column assemblies which neighbor each other, and both ends of which are inserted into the pre-assembled bracket assemblies so as to be mounted in the pre-assembled bracket assemblies.

MODE FOR CARRYING OUT THE INVENTION

Hereinafter, the present invention will be described in detail according to the accompanying drawings and preferred embodiments.

Figure 1:
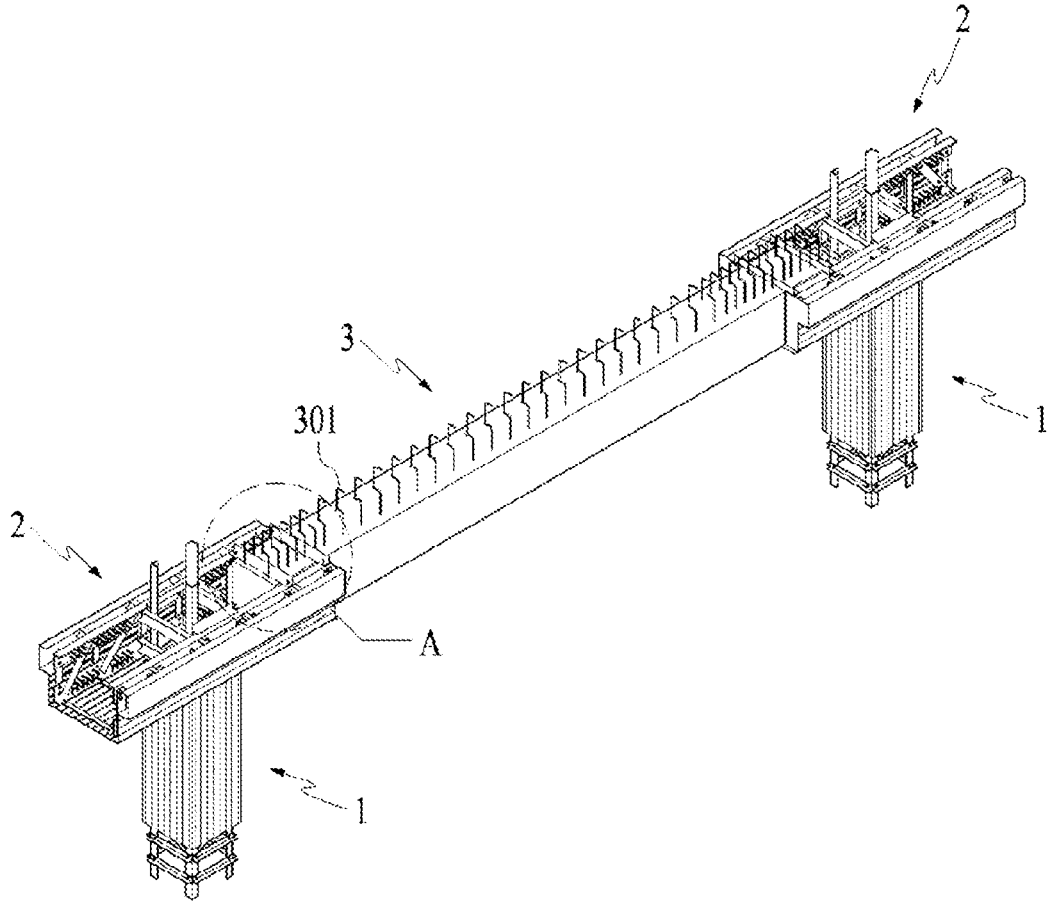
FIG. 1 is a perspective view showing a composite frame according to the present invention.
Figure 2:
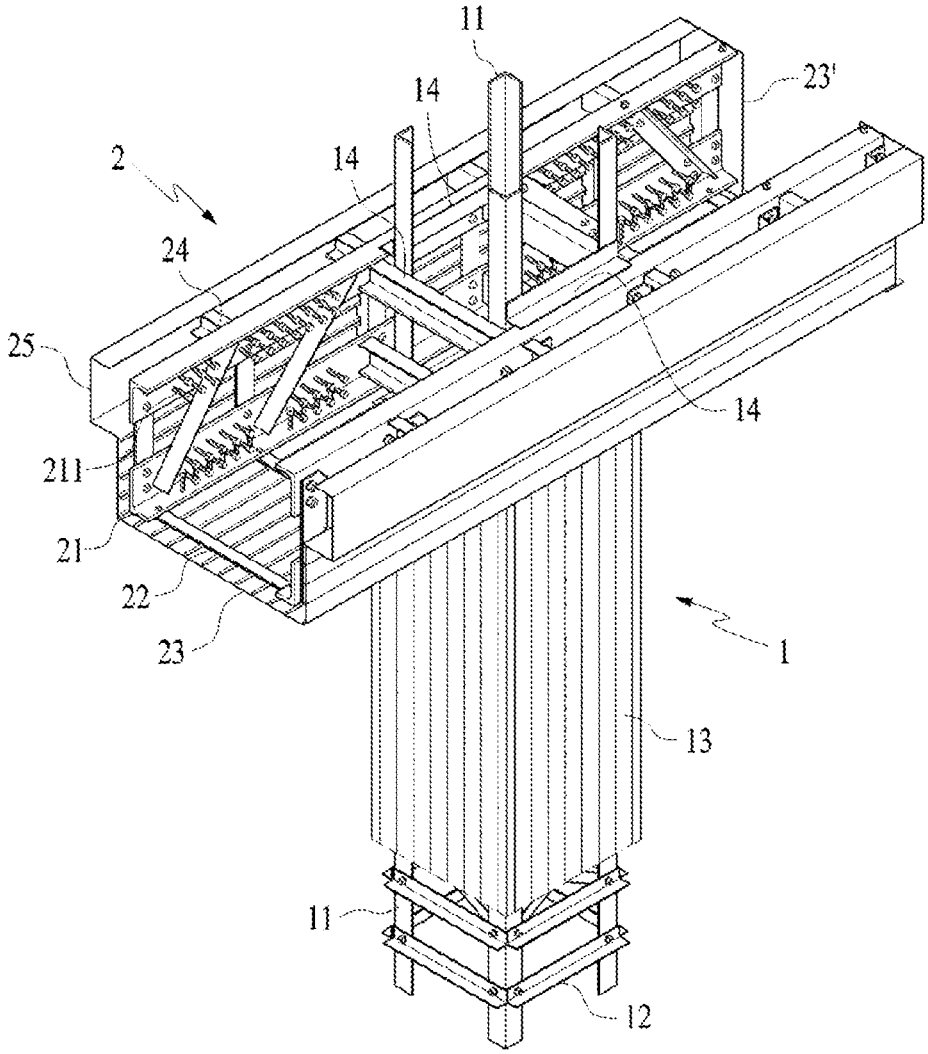
FIG. 2 is a perspective view showing coupling relationship between a pre-assembled column assembly and a pre-assembled bracket assembly.
Figure 3:
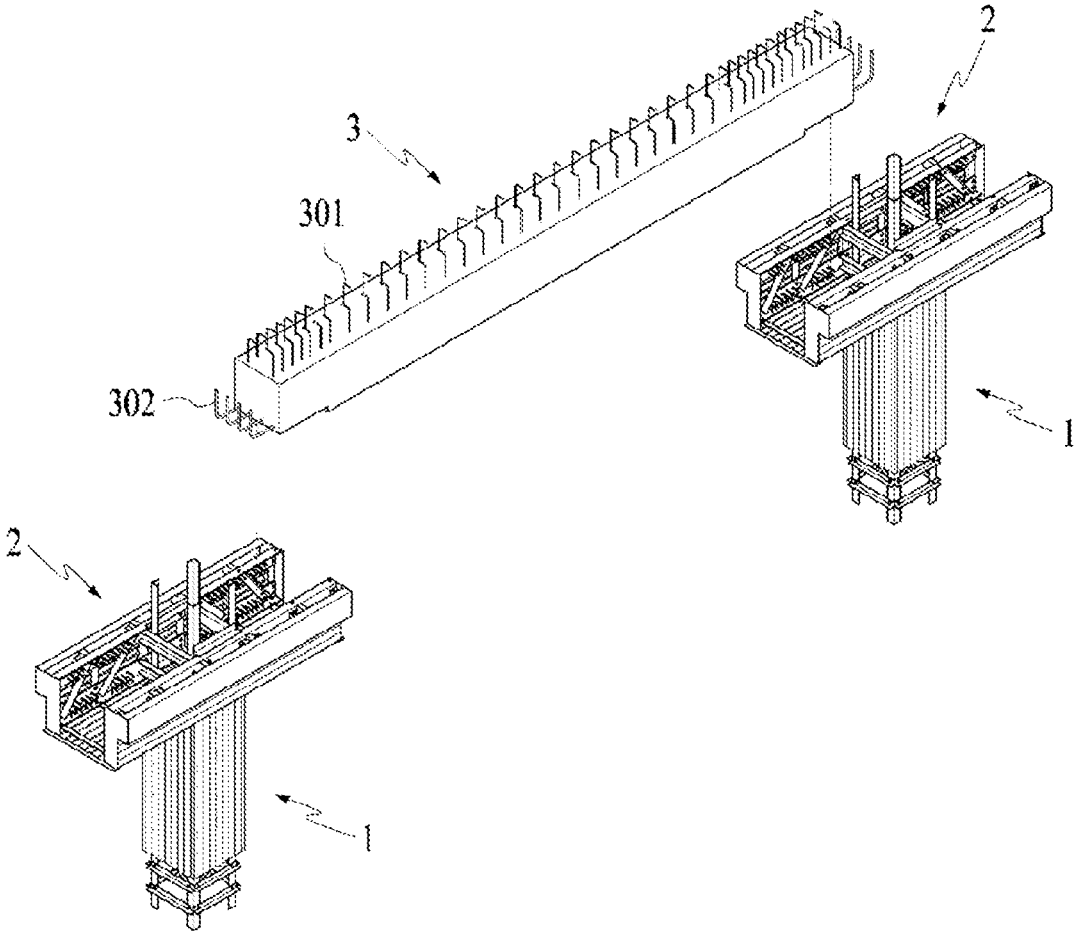
FIG. 3 is a perspective view showing coupling relationship between a girder body and a pre-assembled bracket assembly.

FIG. 1 is a perspective view showing a composite frame according to the present invention, FIG. 2 is a perspective view showing coupling relationship between a pre-assembled column assembly and a pre-assembled bracket assembly, and FIG. 3 is a perspective view showing coupling relationship between a girder body and a pre-assembled bracket assembly.

As shown in FIG. 1 to FIG. 3, etc., according to the present invention, a composite frame having an end-embedded girder joint structure, includes: a plurality of pre-assembled column assemblies 1, each including a plurality of first main steel section members 11 disposed in a vertical direction at each corner of a column member, and first connecting bars 12 coupled to outer surfaces of the first main steel section members 11 so as to interconnect the first main steel section members 11 neighboring each other; pre-assembled bracket assemblies 2 disposed in a transverse direction on upper ends of the pre-assembled column assemblies 1, having open upper surface portions, and including four second main steel section members 21, which are provided in a horizontal direction at left and right sides at intervals from each other up and down on the outside of the pre-assembled column assemblies 1 and protrude to the outside of the pre-assembled column assemblies 1, and second connecting bars 22 for interconnecting the second main steel section members 21 neighboring each other vertically and interconnecting the second main steel section members 21 neighboring each other on the left and right at lower portions, respectively; and a girder body 3, which is installed between the pre-assembled bracket assemblies 2 coupled to the pre-assembled column assemblies 1 which neighbor each other, and both end portions of which are inserted into the pre-assembled bracket assemblies 2 so as to be mounted in the pre-assembled bracket assemblies 2.

The present invention is to provide a composite frame having an end-embedded girder joint structure, in which a pre-assembled steel frame assembly is used to form a steel-concrete composite RC structure so that it is possible to reduce a construction period and improve frame quality, a beam-column joint is constructed in a very simple manner so that constructability and safety may be secured, and very simple joining work may be ensured.

The composite frame having an end-embedded girder joint structure, according to the present invention, includes the pre-assembled column assemblies 1, the pre-assembled bracket assemblies 2 and the girder body 3.

According to the present invention, the composite frame is formed in such a manner that the pre-assembled bracket assemblies 2 are coupled to the upper portions of the pre-assembled column assemblies 1 and the girder body 3 is coupled between the pre-assembled bracket assemblies 2 on the pre-assembled column assemblies 1 which neighbor each other.

The pre-assembled column assemblies 1 and the pre-assembled bracket assemblies 2 may be manufactured at a factory or the like in advance so as to form a steel-concrete composite concrete member.

The pre-assembled bracket assemblies 2 may be installed in the field in a pre-assembled state to the pre-assembled column assemblies 1.

The pre-assembled column assembly 1 includes the plurality of first main steel section members 11 and the first connecting bars 12.

The first main steel section members 11 are disposed in a vertical direction at each corner of the column member.

The first main steel section members 11 are disposed at each corner of the column member, and are disposed at positions spaced apart from surfaces of the column member at predetermined intervals.

The first connecting bars 12 are coupled to the outer surfaces of the first main steel section members 11 so as to interconnect the first main steel section members 11 neighboring each other.

The first connecting bars 12 interconnect the first main steel section members 11 neighboring each other in the transverse direction of the column member.

As for the first main steel section members 11 and the first connecting bars 12, angle members may be adopted.

The first connecting bars 12 may be fixed to the outer surfaces of the first main steel section members 11 by bolting or the like.

The first main steel section members 11 are embedded inside concrete so as to serve as main bars of a column, and the first connecting bars 12 serve as tie hoops.

Lightweight permanent formworks 13 which will be described hereinafter may be provided outside the pre-assembled column assembly 1 under the pre-assembled bracket assembly 2.

The lightweight permanent formworks 13 may be coupled to the first connecting bars 12.

The pre-assembled bracket assembly 2 is horizontally arranged at the upper end of the pre-assembled column assembly 1 in a direction orthogonal to the pre-assembled column assembly 1.

The pre-assembled bracket assembly 2 includes the second main steel section members 21 also serving as main bars and the second connecting bars 22 serving as stirrups by connecting across the second main steel section members 21.

The second main steel section members 21 are disposed in the transverse direction at the upper end of the pre-assembled column assembly 1, wherein the four second main steel section members 21 are provided in the horizontal direction at the left and right sides on the outside of the pre-assembled column assembly 1 and spaced apart from each other in the vertical direction.

The second main steel section members 21 protrude to the outside of the pre-assembled column assembly 1.

The second connecting bars 22 interconnect the second main steel section members 21 neighboring each other vertically and interconnect the second main steel section members 21 neighboring each other on the left and right at a lower portion, respectively. That is, the second connecting bars 22 are provided only on side surfaces of the outer periphery of the pre-assembled bracket assembly 2 and on a lower surface of the pre-assembled bracket assembly 2.

Accordingly, the upper surface portion of the pre-assembled bracket assembly 2 is open and thus the pre-assembled bracket assembly 2 has a U-shaped cross section as a whole.

A lightweight permanent formwork 23 is provided on and coupled to the left and right side surfaces and the lower surface of the pre-assembled bracket assembly 2 so that the upper portion of the pre-assembled bracket assembly 2 is open.

Herein, the lightweight permanent formworks 23 positioned at the lower portion of the pre-assembled bracket assembly 2 may be opened in the center so that the center portion may communicate with the inside of the pre-assembled column assembly 1.

In addition, the first main steel section members 11 of the pre-assembled column assembly 1 may pass through the pre-assembled bracket assembly 2 and protrude upward from the pre-assembled bracket assembly 2 by a predetermined length. The first main steel section member 11 protruding upward can be connected to another pre-assembled column assembly 1 positioned at an upper portion.

The girder body 3 is installed between the pre-assembled bracket assemblies 2 coupled to the neighboring pre-assembled column assemblies 1, wherein the both end portions of the girder body 3 are inserted into and mounted in the pre-assembled bracket assemblies 2, respectively.

The end portions of the girder body 3 are inserted into the pre-assembled bracket assemblies 2 having the open upper portions so as to overlap the second main steel section members 21 by a predetermined length.

The girder body 3 and the pre-assembly bracket assemblies 2 may form one girder by pouring concrete therein.

That is, after installing the girder body 3, concrete is poured into the inside of the pre-assembled bracket assemblies 2 and the inside of the pre-assembled column assemblies 1 so that a steel-concrete composite concrete member is formed. Herein, the concrete covers the outside of the girder body 3, which is inserted into and overlaps the pre-assembled bracket assemblies 2, so that the girder body 3 and the pre-assembled bracket assemblies 2 are structurally integrated.

A plurality of stud bolts 211 may be fastened to the inside of the second main steel section members 21 for integration with the concrete cast in the pre-assembled bracket assemblies 2. Accordingly, the second main steel section members 21 and the girder body 3 can be integrated through the concrete.

As described above, in the present invention, it is possible to integrate the girder body 3 and the pre-assembled bracket assemblies 2 only through the process of pouring concrete after simply mounting the girder body 3 without any separate joining process. Therefore, members can be joined in a very simple and quick manner, and the burden of lifting equipment can be minimized.

The girder body 3 is inserted between left and right second main steel section members 21 of the respective pre-assembled bracket assemblies 2.

Since the lightweight permanent formworks 23 provided at the left and right on the outside of the pre-assembled bracket assembly 2 are spaced apart from the second main steel section members 21 so as to secure covering thickness, end portions of the pre-assembled bracket assemblies 2 are open with respect to the outside of the girder body 3.

Therefore, the end portions of the pre-assembled bracket assemblies 2 may be provided with end forms 23' for closing the open end portions of the pre-assembled bracket assemblies 2 with respect to the outside of the girder body 3.

As shown in FIG. 2, a fixing bar 14 may be coupled to outer surfaces of the first main steel section members 11 of the pre-assembled column assembly 1 and one side of the fixing bar 14 is fixed to the second main steel section member 21 of the pre-assembled bracket assembly 2 so as to fix the pre-assembled bracket assembly 2 to the pre-assembled column assembly 1.

The pre-assembled column assembly 1 and the pre-assembled bracket assembly 2 may form a mutually integrated structure by concrete integrally poured therein. However, separate measures are required to fix the pre-assembled column assembly 1 and the pre-assembled bracket assembly 2 during construction.

Therefore, the first main steel section member 11 of the pre-assembled column assembly 1 and the second main steel section member 21 of the pre-assembled bracket assembly 2 can be interconnected and fixed using the fixing bar 14.

Each one pair of fixing bars 14 may be provided on the left and right sides and front and rear sides of a plurality of first main steel section members 11.

One side of each of the fixing bars 14 provided on the left and right sides may be fixed to the outside of the first main steel section members 11, and the other side may be fixed to the upper or lower portion of a second main steel section member 21, for example, to the upper surface of an upper second main steel section member 21 or the lower surface of a lower second main steel section member 21.

One side of each of the fixing bars 14 provided on the front and rear sides may be fixed to the outside of the first main steel section members 11, and both ends may be fixed to inner surfaces of left and right second main steel section members 21, respectively.

As for the fixing bars 14, angle members may be adopted.

The fixing bars 14 may be fixed to the first main steel section members 11 or the second main steel section members 21 by welding or bolting, etc.

As shown in FIG. 1, FIG. 3, etc., the girder body 3 may be composed of a PC member.

Conventionally, in order to join a PC member to steel frame members or a steel-concrete composite member (a steel frame-RC member), a steel frame member needs to be embedded in the PC member and joined by bolting or welding between the steel frame members.

In this case, manufacturing of the PC member is complicated and economic efficiency is low.

On the other hand, according to the present invention, the end portions of the girder body 3 are simply inserted into and mounted inside the pre-assembled bracket assemblies 2 of which upper surface is open, and then concrete is poured to integrate the girder body 3 and the pre-assembled bracket assemblies 2. Therefore, in order to join the pre-assembled bracket assemblies 2, which are steel concrete composite members, and the girder body 3, which is a PC member, it is not necessary to embed any separate steel frame member for joining.

Accordingly, the girder body 3, which is a PC member, can have a very simple shape.

The girder body 3, which is a PC member, can be configured such that for integration with slabs, upper anchorage bars 301 are exposed from an upper portion and end anchorage bars 302 protrude from end portions so as to be fixed inside the concrete inside the pre-assembled bracket assemblies 2.

Figure 4:
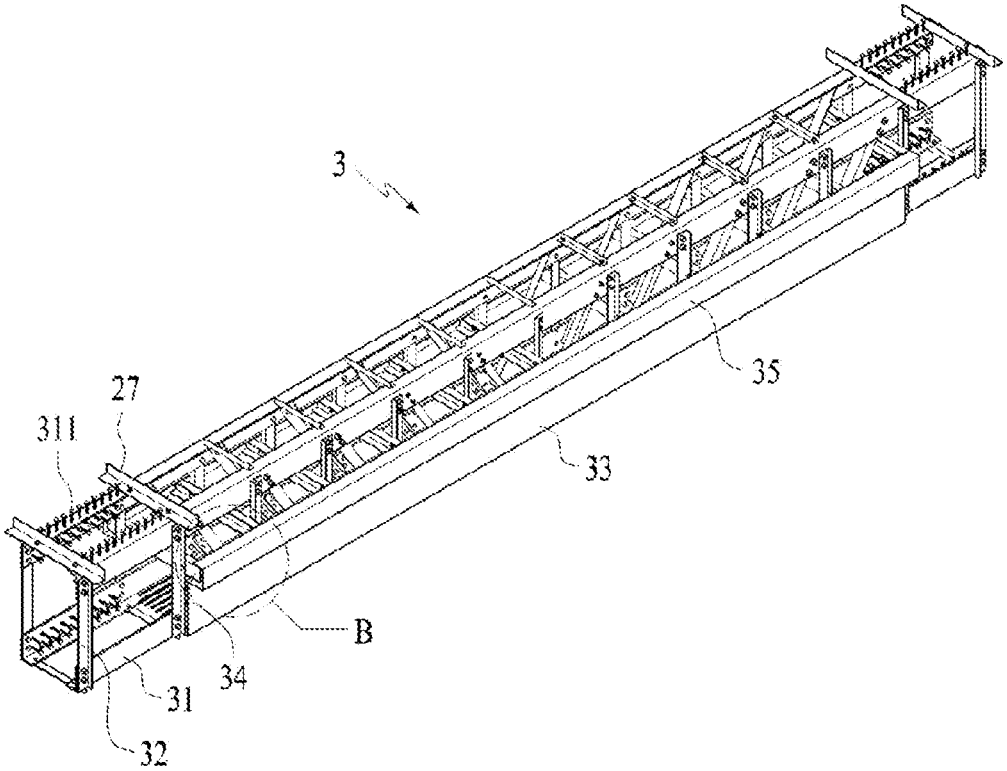
FIG. 4 is a perspective view showing a girder body, which is a pre-assembled steel frame assembly.
Figure 5:
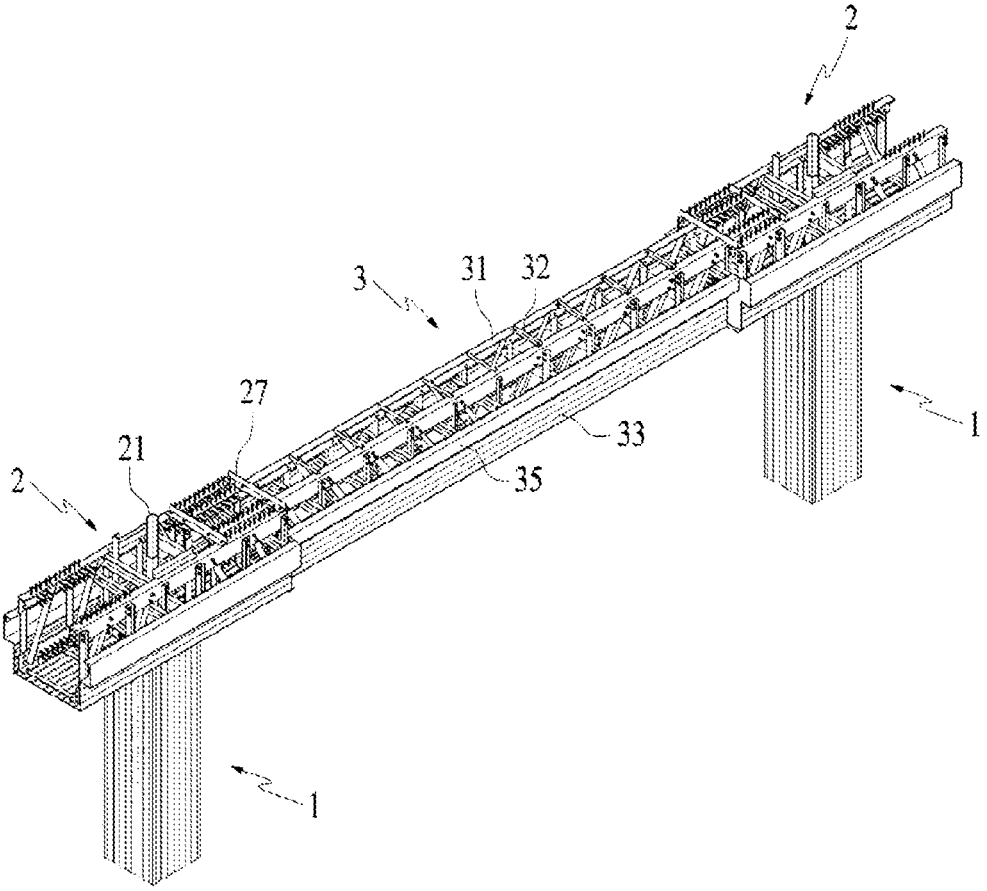
FIG. 5 is a perspective view showing an installation state of a girder body, which is a pre-assembled steel frame assembly.

FIG. 4 is a perspective view showing a girder body, which is a pre-assembled steel frame assembly, and FIG. 5 is a perspective view showing an installation state of a girder body, which is a pre-assembled steel frame assembly.

As shown in FIG. 4 and FIG. 5, the girder body 3 may include a plurality of third main steel section members 31 disposed at each corner of the girder body 3 in the longitudinal direction and third connecting bars 32 coupled to outer surfaces of the third main steel section members 31 neighboring each other.

If a span is large or a load is large, it is necessary to increase length or width of the girder body 3. However, since it is difficult to manufacture PC members in a size larger than a certain size due to manufacturing conditions or burden of transportation or lifting, there is a limit in their application to long-span or large-sized members.

Therefore, it is possible to consider a method of constructing the girder body 3 as a pre-assembled steel frame assembly, similar to the pre-assembled column assembly 1 or the pre-assembled bracket assembly 2, so as to reduce the weight of the member and minimize the burden of lifting.

To this end, the girder body 3 may be composed of the plurality of third main steel section members 31 and the third connecting bars 32 for connecting the neighboring third main steel section members 31.

The third connecting bars 32 may be provided on both the left and right sides and the upper and lower surfaces of the girder body 3 so as to interconnect the neighboring third main steel section members 31.

The third connecting bars 32 can be arranged in a truss form so as to effectively support loads.

The girder body 3 may be provided with lightweight permanent formworks 33 on the outside thereof.

As shown in FIG. 4, such lightweight permanent formworks 33 may be provided only in a length portion between the end portions of the pre-assembled bracket assemblies 2 at both sides, and end portions of the third main steel section member 31 may protrude to the outside of the lightweight permanent formworks 33 by a certain length so as to be inserted and mounted into the pre-assembled bracket assemblies 2.

In addition, the girder body 3 may be provided with no lightweight permanent formwork on an upper surface of the girder body 3 so that concrete can be integrally poured inside the girder body 3 when slab concrete is poured.

The third main steel section member 31 may be arranged so as to overlap the second main steel section member 21 by a predetermined length.

The second main steel section member 21 and the third main steel section member 31 may be structurally integrated so as to be continuous by pouring concrete to the outside of the second main steel section member 21 and the third main steel section member 31.

At this time, in order to integrate the second main steel section member 21 and the third main steel section member 31 through concrete, the second main steel section member 21 and the third main steel section member 31 must be firmly embedded in the concrete. To this end, stud bolts 211, 311 may be fastened to mutually overlapping portions of the second main steel section member 21 and the third main steel section member 31.

Figure 6:
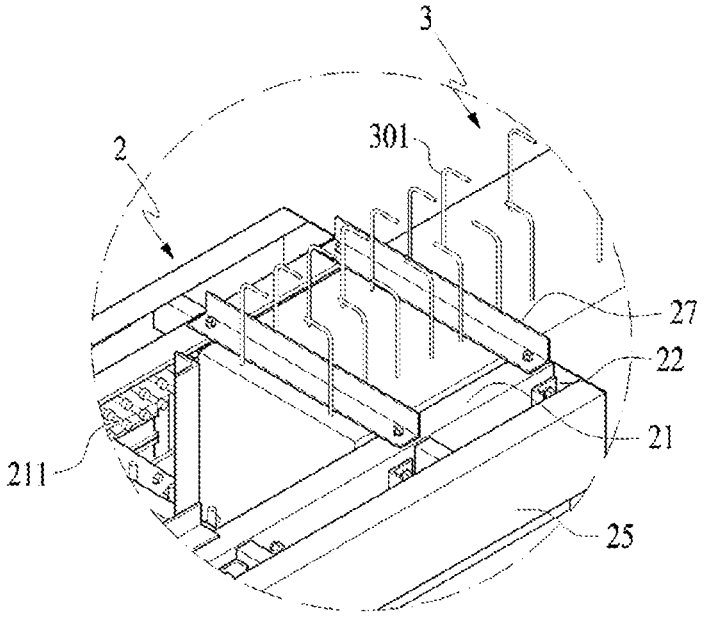
FIG. 6 is an enlarged view showing part A of FIG. 1.

FIG. 6 is an enlarged view showing part A of FIG. 1.

As shown in FIG. 6, upper connecting bars 27 may be coupled to the upper second main steel section members 21 the pre-assembled bracket assembly 2 so as to interconnect the neighboring second main steel section members 21.

Since the pre-assembled bracket assembly 2 is formed in a U-shape with the open upper portion, the lightweight permanent formworks 23 at both sides can be opened by side pressure when PC slabs are mounted on both sides or when concrete is poured.

In order to prevent this, after inserting the end portions of the girder body 3 into the pre-assembled bracket assembly 2, the upper second main steel section members 21 of the pre-assembled bracket assembly 2, which neighbor each other, may be interconnected with the upper connecting bars 27.

The upper connecting bars 27 together with the second connecting bars 22 serve as stirrups for the steel-concrete composite concrete member. In addition, the upper connecting bars 27 are positioned on the upper portion of the girder body 3 so as to serve to fix the position of the girder body 3.

When the girder body 3 is a PC member, the upper connecting bars 27 may fix the girder body 3 by pressing the upper surface of the girder body 3 (FIG. 6).

The upper connecting bars 27 can fix the position of the girder body 3 by being caught between the plurality of upper anchorage bars 301 protruding upward from the girder body 3.

When the girder body 3 is a pre-assembled steel frame assembly, the upper connecting bars 27 may be coupled to the upper surfaces of the upper third main steel section members 31 of the girder body 3 in advance (FIG. 4).

In this case, after installing the girder body 3, both ends of the upper connecting bars 27 may be fixed to the upper portions of the second main steel section members 21 by bolting or the like.

Figure 7:
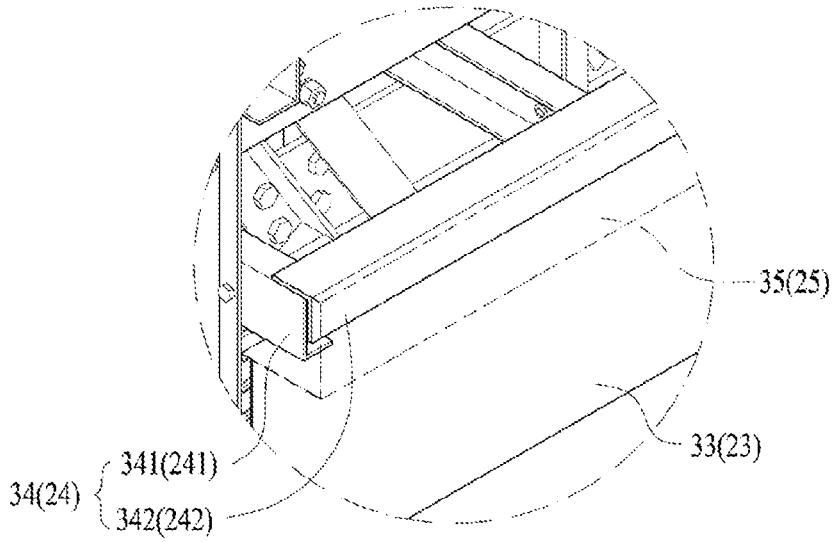
FIG. 7 is an enlarged view showing part B of FIG. 4.

FIG. 7 is an enlarged view showing part B of FIG. 4.

As shown in FIG. 2 and FIG. 7, a support frame 24 for mounting a PC slab may be provided so as to protrude from a side surface of the pre-assembled bracket assembly 2, and cover plates 25 may be provided on side and bottom surfaces of the protruding support frame 24.

The support frame 24 may be directly coupled to the outside of the second main steel section members 21 according to height of the upper second main steel section members 21 of the pre-assembled bracket assembly 2. Alternatively, the support frame 24 may be provided at a height between the upper and lower second main steel section members 21 so as to pass through the pre-assembled bracket assembly 2 in a width direction from the left and right.

That is, in the present invention, the upper surface of the girder body 3 is provided at a height same as that of the upper surfaces of the upper second main steel section members 21 of the pre-assembled bracket assembly 2. If the girder body 3 is a PC member, the upper surface of the girder body 3 is provided at a height same as that of the lower surface of PC slabs. Therefore, the support frame 24 can be coupled to the outside of the second main steel section members 21 so as to be provided at the same height as that of the upper second main steel section members 21.

If the girder body 3 is a pre-assembled steel frame assembly, the third main steel section members 31 are provided at a position higher than that of PC slabs, and the second main steel section members 21 are provided at a height same as that of the third main steel section members 31. Therefore, the support frame 24 may be provided at a position lower than that of the second main steel section members 21.

If the support frame 24 is positioned below the second main steel section members 21, the support frame 24 may be fixed to one side of the second connecting bar 22.

In this case, the support frame 24 not only transmits loads of PC slabs to vertical members, but also serves as a width support for preventing the pre-assembled bracket assembly 2, which has the U-shaped cross section, from opening due to the open upper portion.

The support frame 24 may include a transverse bar 241 disposed in the width direction thereof and a longitudinal bar 242 disposed in the longitudinal direction thereof (FIG. 7).

If the girder body 3 is a pre-assembled steel frame assembly, the girder body 3 may also include a support frame 34 and a cover plate 35 for mounting PC slab.

The support frame 34 can also be composed of a transverse bar 341 and a longitudinal bar 342.

Figure 8:
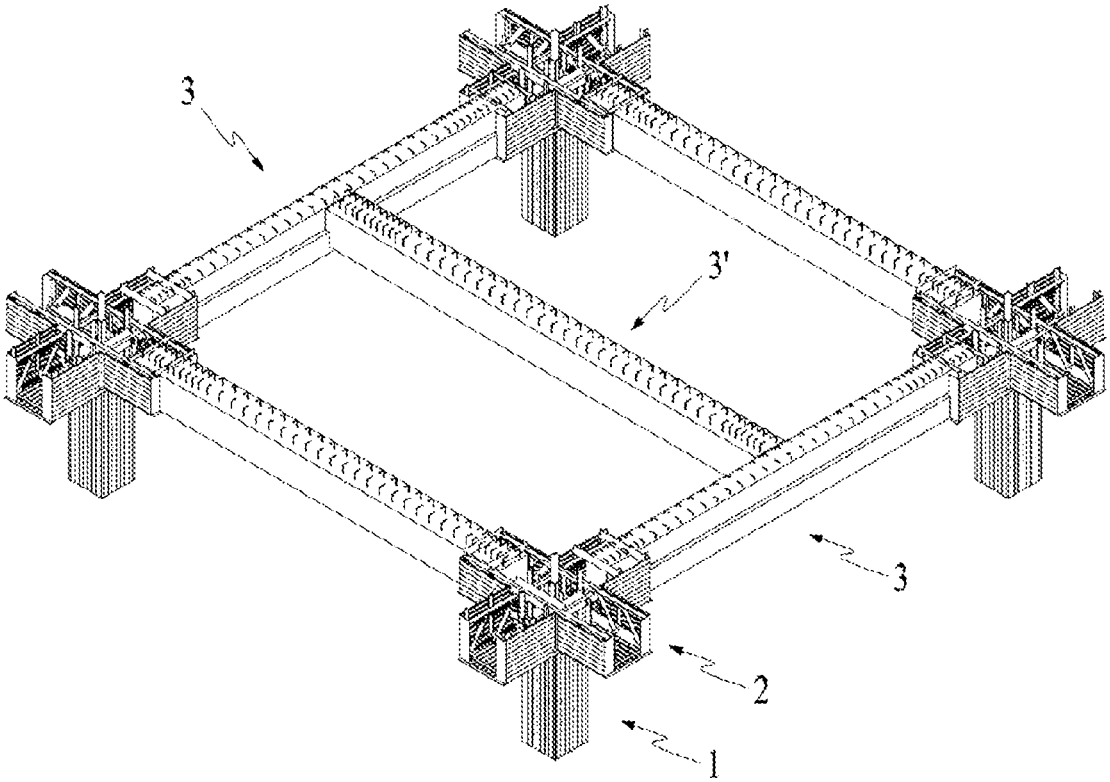
FIG. 8 is a perspective view showing an installation state of a two-way PC girder.

FIG. 8 is a perspective view showing an installation state of a two-way PC girder.

As shown in FIG. 8, in intermediate columns, two pre-assembled bracket assemblies 2 may be provided to cross each other so as to form a "+" shape, and accordingly, PC girders may be installed in two directions.

In addition, a beam 3' may be installed between girder bodies 3 installed at positions facing each other.

INDUSTRIAL APPLICABILITY

The composite frame having an end-embedded girder joint structure according to the present invention is industrially applicable in that a girder body is simply placed in the U-shaped pre-assembled bracket assemblies coupled to the upper ends of the pre-assembled column assemblies and then integrated by pouring concrete, so that it is possible to reduce a construction period and improve frame quality when forming a steel-concrete composite RC structure and a beam-column joint may be constructed in a very simple manner, thereby securing constructability and safety and ensuring very rapid joining work.

The invention claimed is:

1. A composite frame having an end-embedded girder joint structure, comprising:

a plurality of pre-assembled column assemblies (1), each including a plurality of first main steel section members (11) disposed in a vertical direction at each corner of a column member, and first connecting bars (12) coupled to outer surfaces of the first main steel section members (11) so as to interconnect the first main steel section members (11) neighboring each other;

pre-assembled bracket assemblies (2) disposed in a transverse direction on upper ends of the pre-assembled column assemblies (1), having open upper surface portions, and including four second main steel section members (21) provided in a horizontal direction at left and right sides of the pre-assembled column assemblies (1) at positions spaced apart from each other vertically and protruding to the outside of the pre-assembled column assemblies (1), and second connecting bars (22) for interconnecting the second main steel section members (21) neighboring each other vertically and interconnecting the second main steel section members (21) neighboring each other on the left and right at lower portions;

a girder body (3) installed between the pre-assembled bracket assemblies (2) coupled to the neighboring pre-assembled column assemblies (1), both end portions of the girder body (3) being inserted into the pre-assembled bracket assemblies (2) so as to overlap the second main steel section members (21) by a predetermined length and be mounted in the pre-assembled bracket assemblies (2); and concrete poured inside the pre assembled bracket assemblies (2) so as to cover an outside of the girder body (3) and structurally integrate the girder body (3) with the pre-assembled bracket assemblies (2).

2. The composite frame according to claim 1, wherein a fixing bar (14) is coupled to outer surfaces of the first main steel section members (11) of the pre-assembled column assembly (1) and one side of the fixing bar (14) is fixed to the second main steel section member (21) of the pre-assembled bracket assembly (2) so as to fix the pre-assembled bracket assembly (2) to the pre-assembled column assembly (1).

3. The composite frame according to claim 1, wherein the girder body (3) is a precast concrete (PC) member.

4. The composite frame according to claim 1, wherein the girder body (3) includes a plurality of third main steel section members (31) disposed in a longitudinal direction at each corner of the girder body (3), and third connecting bars (32) coupled to the outer surfaces of the third main steel section members (31) which neighbor each other.

5. The composite frame according to claim 1, wherein upper connecting bars (27) are coupled to the second main steel section members (21) at upper portions of the pre-assembled bracket assembly (2) so as to interconnect the second main steel section members (21) which neighbor each other.

* * * * *